US009816152B2

(12) United States Patent
Ma et al.

(10) Patent No.: US 9,816,152 B2
(45) Date of Patent: Nov. 14, 2017

(54) MANUFACTURE METHOD OF HIGH-EFFICIENCY NON-ORIENTED SILICON STEEL WITH EXCELLENT MAGNETIC PERFORMANCE

(75) Inventors: Aihua Ma, Shanghai (CN); Bo Wang, Shanghai (CN); Shishu Xie, Shanghai (CN); Zhanyuan Hu, Shanghai (CN); Liang Zou, Shanghai (CN); Zitao Wang, Shanghai (CN); Yuhua Zhu, Shanghai (CN); Jie Huang, Shanghai (CN); Bingzhong Jin, Shanghai (CN); Xiandong Liu, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 177 days.

(21) Appl. No.: 13/637,611

(22) PCT Filed: Apr. 27, 2011

(86) PCT No.: PCT/CN2011/073373

§ 371 (c)(1),
(2), (4) Date: Dec. 11, 2012

(87) PCT Pub. No.: WO2012/055224

PCT Pub. Date: May 3, 2012

(65) Prior Publication Data

US 2013/0199675 A1 Aug. 8, 2013

(30) Foreign Application Priority Data

Oct. 25, 2010 (CN) ..... 2010 1 0518012

(51) Int. Cl.

| | |
|---|---|
| ***C21D 8/00*** | (2006.01) |
| ***C22C 38/60*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C21D 8/12*** | (2006.01) |
| ***H01F 1/16*** | (2006.01) |

(52) U.S. Cl.

CPC ..... *C21D 8/005* (2013.01); *C21D 8/1261* (2013.01); *C21D 8/1272* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/14* (2013.01); *C22C 38/60* (2013.01); *H01F 1/16* (2013.01)

(58) Field of Classification Search

USPC ..... 148/505

See application file for complete search history.

(56) References Cited

U.S. PATENT DOCUMENTS

| | | | | | |
|---|---|---|---|---|---|
| 3,196,054 | A | * | 7/1965 | Jackson | C21D 1/74 148/110 |
| 4,204,890 | A | * | 5/1980 | Irie et al. | 148/111 |
| 4,898,627 | A | * | 2/1990 | Schoen | C21D 1/26 148/111 |

FOREIGN PATENT DOCUMENTS

| | | | | |
|---|---|---|---|---|
| CN | 1611616 | A | * | 5/2005 |
| CN | 1888111 | A | * | 1/2007 |
| CN | 101358318 | A | | 2/2009 |
| JP | 62054023 | A | * | 3/1987 |
| JP | 2002302718 | A | | 10/2002 |
| JP | 2005002401 | A | * | 1/2005 |

OTHER PUBLICATIONS

X. Duan, "Effect of annealing temperature and heating rate on the magnetic and mechanical properties of electrical steel", Jul. 1, 1996,Journal of Magnetism and Magnetic Materials, vol. 160, pp. 133-135.*

International Search Report dated Aug. 4, 2011 in connection with PCT/CN2011/073373.

* cited by examiner

*Primary Examiner* — Roy King
*Assistant Examiner* — Jophy S Koshy
(74) *Attorney, Agent, or Firm* — Quarles & Brady LLP

(57) ABSTRACT

A manufacture method of high-efficiency non-oriented silicon steel with excellent magnetic property includes the steps of smelting a chemical composition of non-oriented silicon steel, by weight percent, is: C≤0.0040%, Si:0.1~0.8%, Al:0.002~1.0%, Mn:0.10~1.50%, P:≤0.2%, Sb:0.04~0.08%, S≤0.0030%, N≤0.0020%, Ti≤0.0020%, and the rest is Fe and unavoidable inclusions. The molten steel is then cast into billets which are hot-rolled into a hot-rolled product. The heating temperature for the billet is 1100°~1150° and the finish-rolling temperature is 860°~920°. The hot-rolled product is then air cooled for a period of time within a range determined by air cooling time t: (2+30xSb %)s≤t≤7 s. The hot-rolled product is reeled at a temperature ≥720° and cold-rolled to form cold-rolled plate with a target thickness at a reduction ratio of 70~78% followed by heating up the cold-rolled plate to 800~1000° at heating rate of ≥15°/s, and holding time of 10 s~25 s.

2 Claims, 2 Drawing Sheets

MANUFACTURE METHOD OF HIGH-EFFICIENCY NON-ORIENTED SILICON STEEL WITH EXCELLENT MAGNETIC PERFORMANCE

CROSS-REFERENCE TO RELATED APPLICATIONS

This application represents the national stage entry of PCT International Application No. PCT/CN2011/073373 filed Apr. 27, 2011, which claims the benefit of Chinese Patent Application No. 201010518012.5 filed on Oct. 25, 2010, both of which are incorporated herein by reference in their entirety for all purposes.

FIELD OF THE INVENTION

This invention relates generally to a manufacture method of non-oriented electric steel, and particularly, to a manufacture method of high-efficiency non-oriented silicon steel with excellent magnetic property, to solve shortcomings of traditional technology for manufacturing high-efficiency non-oriented silicon steel, such as high cost and long manufacturing cycle.

BACKGROUND

With progress of electric power industry, electric appliance industry, electromechanical products are developing towards miniaturization, high accuracy and high efficiency. Iron cores made of ordinary cold-rolled silicon steel sheet are hard to meet various requirements. Accordingly, it is an important approach to develop a series of efficient non-oriented electric steel products of low-iron-loss, high-magnetic-induction to take the place of ordinary cold-rolled silicon steel sheet, so as to reduce volume, reduce weight, and save steel and copper consumption, and improve efficiency for electromechanical products.

Main magnetic feature of high-efficiency non-oriented silicon steel lies in high magnetic induction. The features of its conventional manufacture process lie in that: after being hot-rolled, the hot-rolled plates are normalized to homogenize texture of the hot-rolled plates increase re-crystallized grains, prevent corrugation-shaped defects, and meanwhile to make grains and separated substances more coarse, intensify components (110) and (100), decrease component (111) and thus improve magnetic property significantly. In order to enhance magnetic induction, normalization temperature is usually over 950° C. However, the normalization of hot-rolled plates brings problems of high manufacture cost and long manufacturing cycle.

Chinese patent CN1288070 discloses a non-oriented silicon steel, compositions of which are: C≤0.008%, Si 0.2-2.50%, Mn 0.15-0.8%, Als residual volume~1.50%, B residual volume~0.0035%, P+Sn/Sb 0.08-0.45%, S≤0.003%, N≤0.003%, the rest being Fe and unavoidable impurities. Iron cores of high-efficiency electric machine are manufactured by processes of low temperature hot-rolling, single cold-rolling and dry gas or moisture annealing.

Japanese patent publication 2004-169141 refers to normalization-exemption production of hot-rolled plate of high grade steel with compositions 1.8%≤(Si+2Al)≤5%, which requires that one or two among REM, Mg and Ca should be added during steelmaking, and meanwhile Ti content should be strictly controlled Ti≤0.003%; during hot-rolling, it is required to finish-roll at 950° C. or more, and reel at 700° C. or less. The shortcomings of this production lie in rigorous hot-rolling process conditions, high finish-rolling temperature and difficulties in actual production operation and control.

Patents about annealing-exemption process for hot-rolled plates further involve Japanese patent publication 2008-260980, which requires that composition system of the steel therein belongs to steel group of high Si content that requires Si content between 1.5%-3.5%, (% Si+% Al)≥1.9%; at the time of hot-rolling, heating temperature for slab is high, being 1230-1320° C.; finish-rolling temperature is at 1050° C. or more, and reeling temperature is at 700° C. or less. The shortcomings of this process lie in hot-rolling temperature for slab of the hot-rolled plate being too high, and MnS and AlN being prone to thinly disperse and separate out during hot-rolling process to deteriorate magnetic property, and to make surface scale hard for removal.

SUMMARY

Object of the present invention is to provide a manufacture method of high-efficiency non-oriented silicon steel with excellent magnetic property. This method, under a precondition to ensure magnetic properties, implements production of the high-efficiency electric steel at relatively low cost by adding elements that are advantageous for generation of desired metallographic texture, controlling contents of adverse elements and coordinating air cooling time control during hot-rolling with high temperature reeling.

In order to attain the above object, solution of the present invention is:

a manufacture method of high-efficiency non-oriented silicon steel sheet with excellent magnetic property, which comprises the following steps:

1) smelting and casting chemical compositions of non-oriented silicon steel, by weight percent are: C≤0.0040%, Si: 0.1-0.8%, Al:0.002-1.0%, Mn:0.10-1.50%, P:≤0.2%, Sb:0.04-0.08%, S≤0.0030%, N≤0.0020%, Ti≤0.0020%, and the rest is Fe and unavoidable impurities;

molten steel in accordance with the above compositions is smelted and then casted into billets;

2) hot-rolling and pickling heating temperature for slab is 1100° C.-1150° C. and finish-rolling temperature is 860° C.-920° C.; after rolling, the hot-rolled product is air cooled, during which air cooling time t: (2+30xSb %)s≤t≤7 s; thereafter reeling at a temperature ≥720° C.;

3) cold-rolling rolling to form cold-rolled plate with target thickness at a reduction ratio of 70-78%;

4) annealing heating up the cold-rolled plate to 800-1000° C. at heating rate of ≥15° C./s, and holding time is 10-25 s.

Further, annealing atmosphere is (volume ratio 30%-70%)H2+(volume ratio 70%-30%)N2, and dew point is controlled at −25° C.--40° C.

In composition design of the present invention:

Si: It is soluble in ferrite to form substitution solid solution, being capable to increase matrix resistivity, and reduce iron loss, which is therefore the most important alloying element of electric steel. But, Si degrades magnetic induction. When Si content reaches a certain extent, continuous increase of its content will weaken the effect of iron loss reduce. In the invention, Si content is 0.1-0.8%. Content greater than 0.8% will make B50 hart to meet requirement of high magnetic induction.

Al: It is soluble in ferrite, being capable to increase matrix resistivity, coarsen crystal grains and reduce iron loss, meanwhile it is able to deoxidize and fix nitrogen. But, it is apt to result in oxidation within surface layer of finished steel sheet. Al content greater than 1.5% will cause difficulties in smelting, casting and machining and reduce magnetic induction.

Mn: It, just like Si and Al, can increase resistivity of the steel, reduce iron loss, and form stable MnS with unavoidable inclusion S, so as to eliminate damage of the S on magnetism and prevent hot shortness. The Mn is also soluble in ferrite to form substitution solid solution, to reduce iron loss. Therefore, it is necessary to add Mn content of 0.1% or more. In the invention, Mn content is 0.10-1.50%. Mn content of below 0.1% has unobvious beneficial effect; and Mn content of over 1.5% will lower Ac1 temperature and re-crystallization temperature, and result in $\alpha$-$\gamma$ phase transformation during heat treatment, and thereby deteriorate favorable texture.

P: It is 0.2% or less. Manufacturability of steel sheet might be improved by adding P of a certain amount into the steel. But, if P content exceeds 0.2%, then cold-rolling manufacturability of the steel sheet will be deteriorated.

S: It is harmful to both of manufacturability and magnetism. The S will form fine MnS particles with Mn to impede growth of finished product annealing grains and to deteriorate magnetism seriously. The S can form low-melting-point FeS and $FeS_2$ or eutectics with Fe, and thus cause hot shortness. In the invention, S content is equal or less than 0.003%. Content over 0.003% will great increase of amount of sulfide precipitation, such as MnS, and thus impede growth of grains and deteriorate iron loss. The best control range of S in the present invention is equal or less than 0.002%.

C: It is harmful to magnetism and is an element that strongly impedes growth of grains. Meanwhile, C is an element that enlarges $\gamma$ phase region. Excessive C will make amount of transformation between $\alpha$ and $\gamma$ phase regions increase during normalization, so as to reduce Ac1 points greatly, to fine crystalline structure, and to increase iron loss. In the present invention, $C \leq 0.004\%$, and the optimal range is $C \leq 0.002\%$.

N: it is prone to generate fine dispersive nitrides, such as AlN, to seriously impede growth of grains, and to deteriorate iron loss. In the present invention, $N \leq 0.0020\%$, as content being over 0.0020% will seriously impede growth of grains and deteriorate iron loss.

Sb: it is an active element, in the case that clustering occurs at surface layer or grain boundary of the surface layer, the Sb can decrease oxidation within the surface layer, prevent active oxygen from penetrating towards steel base along the grain boundary, improve metallographic texture, promote components (100) and (110) to increase, reduce component (111), and improve B50 effect significantly. Based on research carried out by the present invention, the Sb has most prominent effects for improving magnetic property within a range of 0.04-0.08%.

It has been found in research on high efficiency electric steel for electric machines that when metal Sb is added in the electric steel, it enables texture component {100} <uvw> to increase. Sb is thereby an effective element to enhance magnetism of electric steel. Since metal Sb isolates grain boundary and selectively affects growth of grains of re-crystallized ferrite and so retards growth of (111) grains, number of the (111) grains in rolled material will gradually disappear following addition of Sb.

The present invention have deeply studied impact of hot-rolling process on Sb grain boundary segregation, and thus found that the effect of Sb on improvement of favorable texture is inseparable from cooling course after hot-rolling. In order to make full use of the favorable effect of Sb, a slow cooling should be done at about 700° C., or it should maintain at a certain temperature around 700° C. for a certain period. The range around 700° C. is just temperatures at which Sb will occur intensive grain boundary segregation in non-oriented electric steel.

Referring to FIG. 1 and FIG. 2, a billet, elementary composition of which is 0.26% Si, 0.52% Al, 0.65% Mn, 0.08% P, 0.055% Sb, <0.0030% C, <0.0020% N, undergoes hot-rolling process, different air cooling times, and then being reeled at a high temperature of 720° C., cold-rolled, annealed at 860° C. It can be seen that when the air cooling time ranges from 3.5 S to 7 S, the magnetic property is at a good level.

Referring to FIG. 3 and FIG. 4, reeling temperature and magnetic property of hot-rolled plate is closely related. A high temperature reeling might reduce fibrous tissue in center portion of the hot-rolled plate, and thicken recrystallized layer at the edge. The present invention discovers that as for hot-rolled plate with Si content of 0.1-0.8%, after a reeling process over 720° C., fibrous tissue in the center of the hot-rolled plate basically disappears.

Benefits of the Invention

In comparison to conventional manufacture processes of high-efficiency non-oriented silicon steel, method of the present invention omits normalization procedure of the hot-rolled plate, which is capable to obtain magnetic property equivalent to that of the conventional processes. Iron loss can reach 4.5 W/kg or less, and magnetic induction can reach 1.78 T or more. Meanwhile, segregation element Sb is added, and then manufacture is done in accordance with a air cooling time of $(2+30\times Sb\ \%)s \leq t \leq 7$ s after rolling process, which heavily reduces consumption of cooling water for hot-rolled laminar flow. The application of the present invention might not only shorten manufacture period for types of steel, but also lower manufacture cost for electric steel.

Steel for high efficiency motor produced by this method has stable performance. Comparing with Chinese patent CN1288070, the invention does not involve addition of Sn. Further, in comparison with magnetic properties in this Chinese patent, iron loss of similar type of steel in the present invention is 0.2-1.5 W/kg lower, and magnetic induction is 20-100 Gauss higher. In comparison with ordinary cold-rolled non-oriented silicon steel with similar compositions, the invention might achieve 0.1-0.2 W/kg lower for iron loss, and 0.1 T or more higher for magnetic induction.

DETAILED DESCRIPTION

Figure 1:
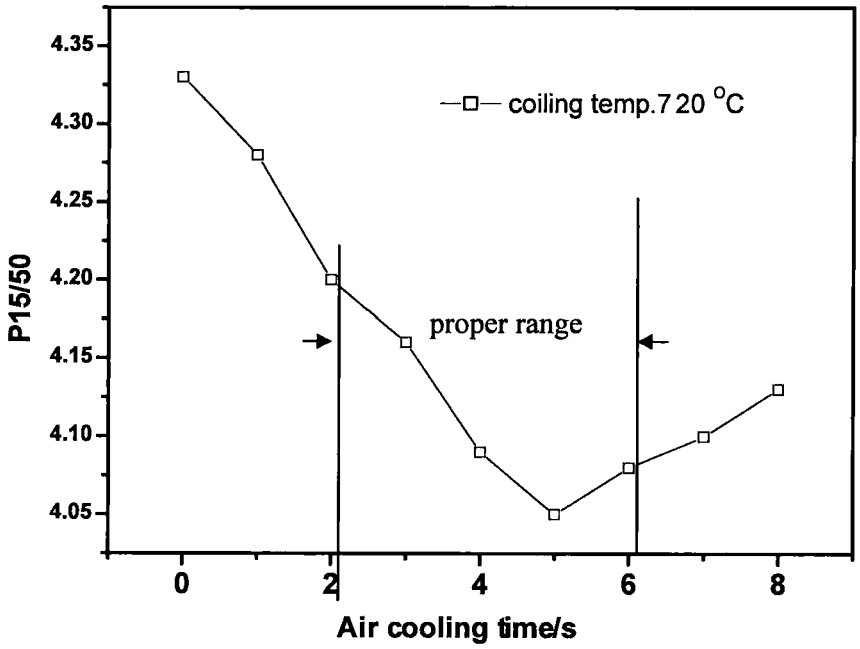
FIG. 1 illustrates relation between air cooling time and magnetic property after hot-rolling process in the case of 0.26% Si and 0.055% Sb.
Figure 2:
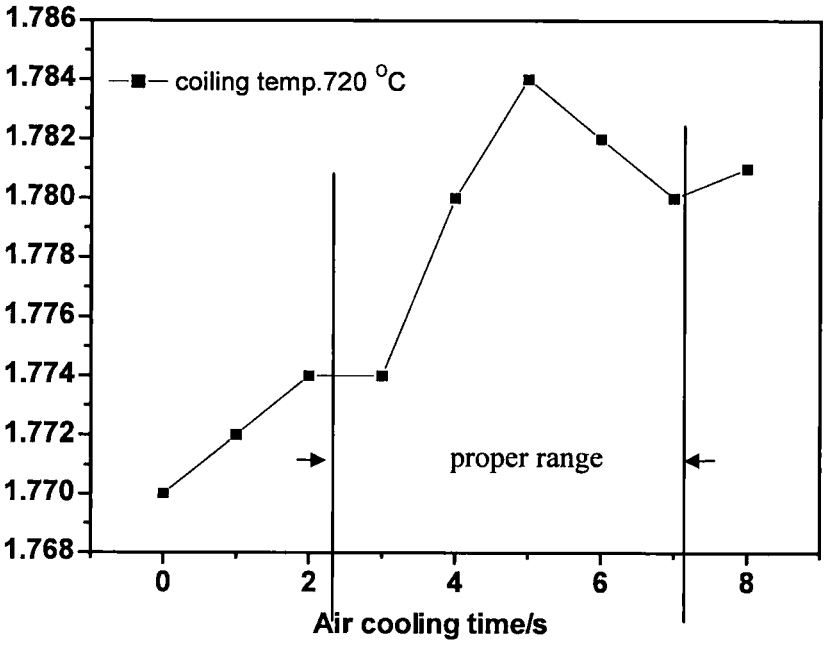
FIG. 2 illustrates relation between air cooling time and magnetic property after hot-rolling process in the case of 0.26% Si and 0.055% Sb.
Figure 3:
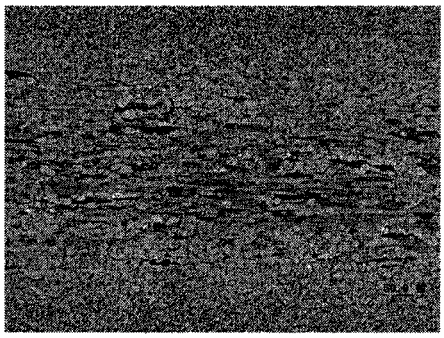
FIG. 3 is a photo of metallographic structure of a hot-rolled plate with contents of 0.26% Si and 0.055% Sb under reeling temperature of 650° C.
Figure 4:
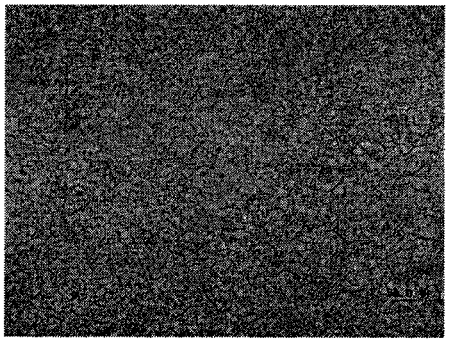
FIG. 4 is a photo of metallographic structure of a hot-rolled plate with contents of 0.26% Si and 0.055% Sb under reeling temperature of 720° C.

The invention is described in detail below in connection with embodiments.

After being smelted, a casted billet in accordance with compositions given in Table 1 undergoes through heating, rough rolling, finish rolling, high temperature reeling, pickling, single cold-rolling at a reduction ratio of 70-78% to form a strip steel with thickness of 0.5 mm, and thereafter the cold-rolled strip steel is final-annealed at different temperatures to form finished product. Table 2 represents manufacture method of the present invention for types of steels with the chemical compositions in Table 1 and results of finished products measured by Epstein's square and circle method.

As can be seen from the Table 2, under the circumstance of the same finish-rolling temperature, reeling temperature and annealing temperature, in comparison with comparative objects without adding Sb and without air cooling after being rolled, magnetic properties of compositions of the embodiments are relatively superior, iron loss thereof is 0.1-0.4 W/kg lower and B50 thereof is 0.2 T or more higher than the ones of the comparative objects.

By measuring magnetic properties of the compositions of embodiments in Table 1 processed in accordance with Table 3, magnetic detection results are shown in Table 3.

TABLE 1

Chemical compositions of embodiments (%)*

| | C | Si | Mn | P | S | Al | N | Ti | Sb |
|---|---|---|---|---|---|---|---|---|---|
| Embodiment 1 | 0.0009 | 0.23 | 0.60 | 0.071 | 0.0020 | 0.45 | 0.0019 | 0.0010 | 0.055 |
| Embodiment 2 | 0.0015 | 0.43 | 1.34 | 0.110 | 0.0015 | 0.69 | 0.0016 | 0.0009 | 0.042 |
| Embodiment 3 | 0.0028 | 0.61 | 0.82 | 0.052 | 0.0020 | 0.88 | 0.0024 | 0.0017 | 0.061 |
| Embodiment 4 | 0.0025 | 0.74 | 0.44 | 0.005 | 0.0012 | 1.06 | 0.0018 | 0.0016 | 0.079 |
| Embodiment 5 | 0.0030 | 0.80 | 1.02 | 0.03 | 0.0018 | 0.002 | 0.0013 | 0.0015 | 0.025 |
| Comparative Object 1 | 0.0010 | 0.22 | 0.54 | 0.073 | 0.0024 | 0.45 | 0.0018 | 0.0006 | — |
| Comparative Object 2 | 0.0012 | 0.44 | 1.2 | 0.110 | 0.0018 | 0.61 | 0.0019 | 0.0008 | — |
| Comparative Object 3 | 0.0018 | 0.68 | 0.78 | 0.055 | 0.0015 | 0.79 | 0.0025 | 0.0015 | — |
| Comparative Object 4 | 0.0026 | 0.75 | 0.42 | 0.005 | 0.0012 | 0.98 | 0.0012 | 0.0012 | — |
| Comparative Object 5 | 0.0017 | 0.80 | 1.06 | 0.034 | 0.0020 | 0.002 | 0.0023 | 0.0017 | — |

*the rest is Fc and unavoidable impurities.

TABLE 2

Manufacture method embodiments and magnetic property results

| | Finish-rolling Temperature FDT (° C.) | Air cooling time in air after hot-rolling s | Reeling Temperature ° C. | Re-crystal-lization annealing ° C. × S | P15/50 W/Kg | B50 T |
|---|---|---|---|---|---|---|
| Embodiment 1 | 880 | 4 | 720 | 820 | 4.38 | 1.796 |
| Embodiment 2 | 860 | 5.5 | 720 | 820 | 3.62 | 1.787 |
| Embodiment 3 | 920 | 6 | 720 | 880 | 4.07 | 1.793 |
| Embodiment 4 | 900 | 6.5 | 720 | 860 | 3.43 | 1.782 |
| Embodiment 5 | 870 | 7 | 720 | 880 | 3.82 | 1.794 |
| Comparative Object 1 | 880 | 0 | 720 | 820 | 4.63 | 1.765 |
| Comparative Object 2 | 860 | 0 | 720 | 820 | 3.79 | 1.759 |
| Comparative Object 3 | 920 | 0 | 720 | 880 | 4.46 | 1.776 |
| Comparative Object 4 | 900 | 0 | 720 | 860 | 3.84 | 1.753 |
| Comparative Object 5 | 870 | 0 | 720 | 880 | 4.24 | 1.768 |

TABLE 3

Manufacture methods and results of magnetic properties of the embodiments

| | Finish-rolling Temperature FDT (° C.) | Air cooling time in air after hot-rolling s | Reeling Temperature ° C. | Re-crystal-lization annealing ° C. × S | P15/50 W/Kg | B50 T |
|---|---|---|---|---|---|---|
| Embodiment 1 | 860 | 4 | 720 | 820 | 4.38 | 1.796 |
| Embodiment 2 | 870 | 5.5 | 720 | 820 | 3.62 | 1.785 |
| Embodiment 3 | 880 | 6 | 720 | 880 | 4.07 | 1.792 |
| Embodiment 4 | 900 | 6.5 | 720 | 860 | 3.43 | 1.784 |
| Embodiment 5 | 920 | 7 | 720 | 880 | 3.79 | 1.790 |
| Comparative Object 1 | 860 | 4 | 570 | 820 | 4.57 | 1.754 |
| Comparative Object 2 | 870 | 5.5 | 600 | 820 | 3.91 | 1.742 |
| Comparative Object 3 | 880 | 6 | 580 | 870 | 4.78 | 1.763 |
| Comparative Object 4 | 900 | 6.5 | 570 | 860 | 4.15 | 1.749 |
| Comparative Object 5 | 920 | 7 | 610 | 880 | 4.63 | 1.760 |

As can be seen from the above Table, the magnetic properties of comparative objects 1-4, which do not undergo high temperature reeling, are significantly lower than the ones of types of steel of the embodiments, which undergoes high temperature reeling.

By measuring magnetic properties of the compositions of embodiment 1 in Table 1 processed in accordance with Table 4, magnetic detection results are shown in Table 4.

TABLE 4

Manufacture methods and results of magnetic properties of the embodiment

| | Sb % | Air cooling time in air after hot-rolling s | Reeling Temper-ature ° C. | Re-crystal-lization annealing ° C. × S | P15/50 W/Kg | B50 T | Remarks |
|---|---|---|---|---|---|---|---|
| Embodiment 1 | 0.055 | 0 | 740 | 820 × 16 | 4.66 | 1.77 | Comparative |
| | | 1 | | | 4.58 | 1.772 | Object |
| | | 2 | | | 4.52 | 1.774 | |
| | | 3 | | | 4.50 | 1.774 | |
| | | 4 | | | 4.33 | 1.79 | The present |
| | | 5 | | | 4.28 | 1.796 | invention |
| | | 6 | | | 4.2 | 1.792 | |
| | | 7 | | | 4.16 | 1.79 | |
| | | 8 | | | 4.33 | 1.788 | |

As can be seen from the above Table, control of air cooling time after hot-rolling is an important factor that affects magnetic properties of finished products. Both of a too short air cooling time and a too long air cooling time are adverse to the magnetic properties of the finished products. In the present invention, the air cooling time t after rolling is controlled within a range of (2+30xSb %)s≤t≤7 s, and so magnetic properties of the finished products are the best.

In summary, the present invention refers to a manufacture method of high-efficiency non-oriented silicon steel with good magnetic properties, characteristics of which lie in adding a certain content of Sb, a grain boundary segregation element, during steel-making process; controlling air cooling process of hot-rolled plate by controlling air cooling time after hot-rolling to be (2+30xSb %)s≤t≤7 s; and meanwhile replacing normalization of hot-rolled plate with high temperature reeling, so as to obtain high efficiency electric steel of high performance and therefore to problems of conventional process for manufacture of high efficiency non-oriented electric steel, such as high cost and long manufacturing cycle etc.

What is claimed is:

1. A manufacture method of non-oriented silicon steel, said method comprising:

smelting a chemical composition of non-oriented silicon steel, which by weight percent, comprising: C≤0.0040%, Si:0.1-0.8%, Al:0.45-1.0%, Mn:0.10-1.50%, P:≤0.2%, Sb:0.055-0.08%, S≤0.0030%, N≤0.0020%, Ti≤0.0020%, and the rest is Fe and unavoidable impurities;

casting said composition into a billet;

hot rolling said billet into a hot-rolled product, wherein heating temperature for said billet is 1100° C.-1150° C. and finish-rolling temperature is 860° C.-920° C.;

air cooling said hot-rolled product for a period of time within a range determined by air cooling time t: (2+30xSb %)s<t<7 s;

reeling at a temperature ≥720° C.;

cold rolling said hot-rolled product to form cold-rolled plates with a target thickness at a reduction ratio of 70-78%; and heating up the cold-rolled plates to 800-1000° C. at a heating rate of ≥15° C./s, with a holding time of 10-25 s.

2. The manufacture method of non-oriented silicon steel of claim 1, in which said step of heating up is in an annealing atmosphere of (volume ratio 30%-70%)$H_2$+(volume ratio 70%-30%)$N_2$, and dew point is controlled at −25° C.--40° C.

* * * * *